United States Patent [19]

Kobayashi et al.

[11] Patent Number: 4,881,630

[45] Date of Patent: Nov. 21, 1989

[54] COIN DISCRIMINATING APPARATUS

[75] Inventors: Osamu Kobayashi, Sakado; Osamu Sugimoto, Iruma; Yonezou Furuya, Saitama; Takeshi Ishida; Masanori Tanaka, both of Sakado; Jun Ishii, Kawagoe, all of Japan

[73] Assignee: Nippon Conlux Co., Ltd., Tokyo, Japan

[21] Appl. No.: 241,817

[22] Filed: Sep. 2, 1988

Related U.S. Application Data

[63] Continuation of Ser. No. 56,335, May 22, 1987, abandoned, which is a continuation of Ser. No. 752,455, Jul. 5, 1985, abandoned.

[30] Foreign Application Priority Data

Jul. 7, 1984 [JP] Japan ..... 59-101975

[51] Int. Cl.[4] ..... G07F 9/00; G07F 3/02; G07F 1/04

[52] U.S. Cl. ..... 194/203; 194/317; 194/345; 194/346

[58] Field of Search ..... 194/203, 317, 318, 319, 194/320, 321, 344, 345, 346, 202; 453/3

[56] References Cited

U.S. PATENT DOCUMENTS

| | | | |
|---|---|---|---|
| 3,012,649 | 12/1961 | White et al. | 194/317 |
| 3,059,749 | 10/1962 | Zinke | 194/319 |
| 3,627,094 | 12/1971 | Kaufman et al. | 194/203 |
| 3,837,454 | 9/1974 | Joeck | 194/318 |
| 3,916,922 | 11/1975 | Prumm | 194/346 X |
| 4,089,400 | 5/1978 | Gregory, Jr. | 194/346 X |
| 4,106,608 | 8/1978 | Dietz | 194/345 |
| 4,106,610 | 8/1978 | Heiman | 194/317 |
| 4,228,811 | 10/1980 | Tanaka et al. | 194/317 X |
| 4,257,435 | 3/1981 | Tanaka et al. | 453/3 |
| 4,257,512 | 3/1981 | Hooker | 194/318 |
| 4,286,703 | 9/1981 | Schuller et al. | 194/317 |
| 4,349,095 | 9/1982 | Lewis | 194/318 |
| 4,576,275 | 3/1986 | Kobayashi et al. | 194/317 X |

FOREIGN PATENT DOCUMENTS

| | | | |
|---|---|---|---|
| 3045734 | 6/1982 | Fed. Rep. of Germany | 133/3 R |

*Primary Examiner*—Joseph J. Rolla
*Assistant Examiner*—Edward S. Ammeer
*Attorney, Agent, or Firm*—Koda & Androlia

[57] ABSTRACT

A plurality of plate members are provided to be aligned with each other in order to define a plurality of coin paths in units of denominations which are aligned with each other and capable of communicating with a common path along which all inserted coins pass. Selectors are provided at a position immediately upstream from two successive aligned coin paths. Each selector is driven by a solenoid operative in accordance with a detection result from a coil for detecting denominations of coins. An inserted coin is directed to a corresponding coin path by the selector.

2 Claims, 4 Drawing Sheets

COIN DISCRIMINATING APPARATUS

This is a continuation of application Ser. No. 056,335, filed May 22, 1987 now abandoned, which is a continuation of application Ser. No. 752,455, filed July 5, 1985, now abandoned.

BACKGROUND OF THE INVENTION

The present invention relates to a coin discriminating apparatus used in an automatic vending machine and a money exchange machine.

A conventional coin discriminating apparatus is known wherein a discriminator such as an electronic discriminator or a cradle and a selector for switching paths for coins are arranged in a coin path formed between two plates, and inserted coins are discriminated and stored. In the conventional coin discriminating apparatus of this type, coin paths are formed on a single plane between two plates in units of coin denominations and inserted coins are discriminated and selected by a cradle and stored. Such coin discriminating apparatuses having the cradle or the like for discriminating and selecting coins must have a plurality of coin paths on a single plane in units of coin denominations. Therefore, the conventional coin discriminating apparatus has a large size and cannot be made compact in size.

SUMMARY OF THE INVENTION

It is an object of the present invention to provide a compact coin discriminating apparatus having a small number of components.

It is another object of the present invention to provide a coin discriminating apparatus wherein a selector for discriminating coins is prevented from being damaged and the discrimination can be performed reliably.

According to the present invention, there is provided a coin discriminating apparatus wherein a denomination of an inserted coin is detected by detection coils arranged to face a common coin path along which all inserted coins to be discriminated pass, a plurality of plate members are vertically arranged to be aligned with each other at the downstream of the common coin path to form a plurality of coin paths between the plates in units of coin denominations, selectors are switched by solenoids activated in accordance with detection results of the detection coils, and each coin is directed to the coin path in accordance with the coin denomination by the selectors.

The above and other objects, features and advantages of the present invention will be apparent from the following detailed description in conjunction with the accompanying drawings.

DETAILED DESCRIPTION OF THE PREFERRED EMBODIMENTS

An embodiment of the present invention will now be described with reference to the accompanying drawings.

Figure 1:
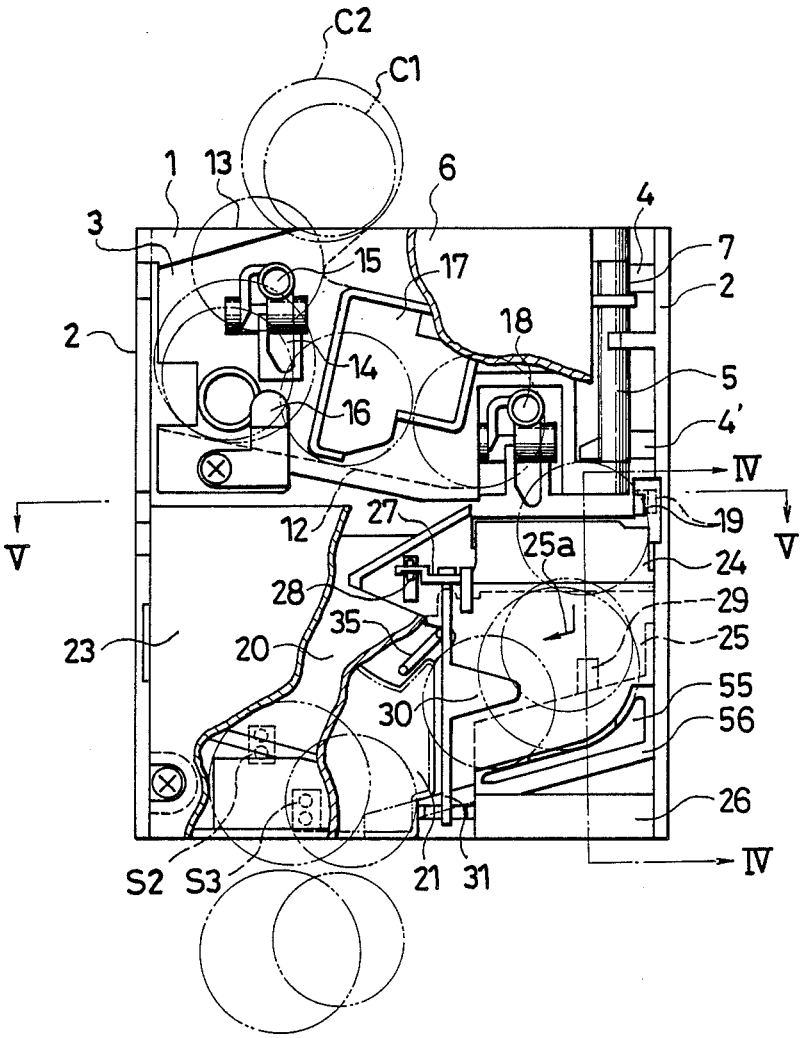
FIG. 1 is a partially cutaway front view of a coin discriminating apparatus according to an embodiment of the present invention.
Figure 2:
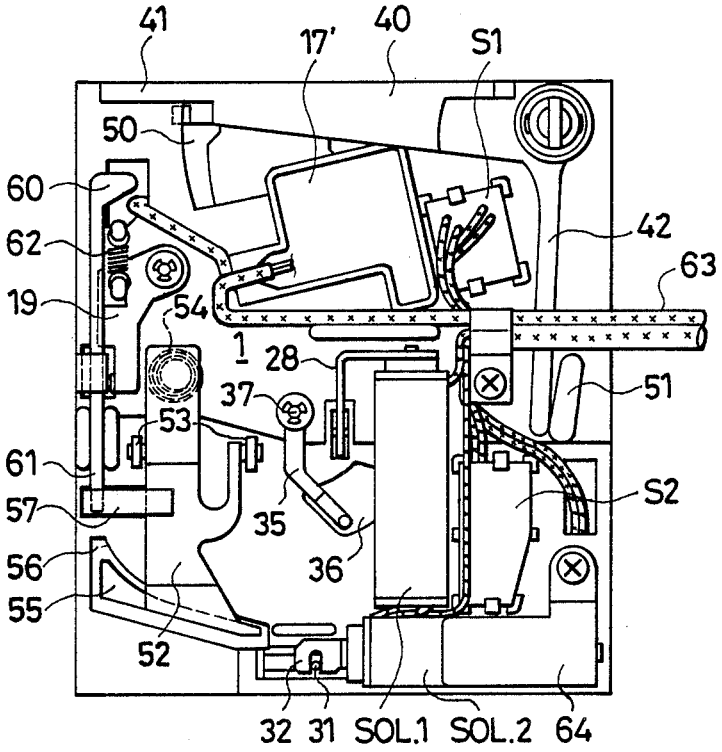
FIG. 2 is a rear view of the coin discriminating apparatus shown in FIG. 1.
Figure 3:
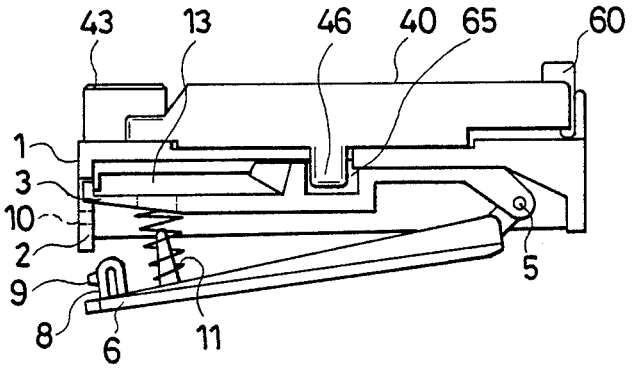
FIG. 3 is a plan view of the coin discriminating apparatus shown in FIG. 1.
Figure 4:
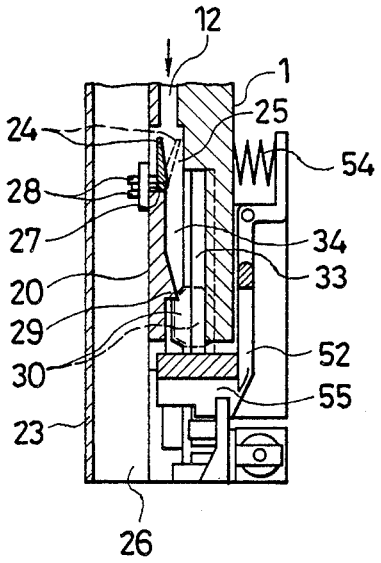
FIG. 4 is a partial sectional view taken along the line IV—IV of FIG. 1.

FIGS. 1 to 6 show a coin discriminating apparatus according to an embodiment of the present invention. Referring to FIGS. 1 to 6, supports 4 and 4′ project from a side plate 2 integrally formed with a base 1 constituting a plate member. A first plate 3 is pivotally supported by a shaft 5 supported by the supports 4 and 4′. A plastic front cover 6 is pivotally engaged in snapping engagement with the shaft 5 through a substantially U-shaped axial support member 7 integrally formed with the cover 6. As shown in FIG. 3, a substantially U-shaped spring 8 is provided to an end of the front cover 6 on the opposite side of the shaft 5. A projection 9 formed on the spring 8 can be engaged with a hole 10 formed in the side plate 2. A spring 11 is fixed to the front cover 6. When the projection 9 is engaged with the hole 10, the spring 11 biases the first plate 3 toward the base 1. A first coin regulating member 14 for urging and regulating 100 and 500 coins C1 and C2 inserted in a coin insertion port 13 is pivotally fixed to the first plate 3 which defines between itself and the base 1 a common coin path 12 along which all inserted coins pass. A weight 15 is provided on the regulating member 14 such that the weight 15 causes a distal end of the regulating member 14 to project into the coin path 12 through the hole formed in the first plate 3. A reflection plate 16 is fixed to the first plate 3, and a reflection sensor S1 (refer to FIG. 2) for detecting a coin is fixed at a predetermined portion of the base 1 corresponding to the reflection plate 16. A pair of coils 17 and 17′ of an electronic discriminating unit for electromagnetically discriminating the denomination of a coin is fixed to the first plate 3 and the base 1, respectively, and defines the coin path 12 therebetween. The electronic discriminating unit is a known device and discriminates the denomination of a coin in accordance with the outputs from the coils 17 and 17′ representing electromagnetic changes due to the presence of the coin in an electromagnetic path, outputs a signal in response to the detected denomination, and drives selector drive solenoids to be described later. A second coin regulating member 18 having substantially the same configuration as that of the first coin regulating member 14 is pivotally fixed to the first plate 3 in order to urge the coin toward the base 1. An absorber lever 19 is arranged at a portion of the side plate 2 at which a passing direction of the coin changes, e.g., the lower curved portion of the path 12 in order to absorb an impact of the coin passing downward along the path 12 against the side plate 2.

At a lower portion of the coin discriminating apparatus, a third plate 21, a second plate 20 and a second front cover 23 are vertically arranged on the base 1 to be aligned with each other in the order named. A first selector 24 is arranged at a position immediately downstream from the lower curved portion of the path 12. A coin passing downward along the path 12 is directed by the first selector 24 to either an authentic coin path 25 defined by the base 1 and the second plate 20 or a return path 26 defined by the second plate 20 and the second front cover 23. A shaft 27 of the first selector 24 is pivotally supported on the base 1. The shaft 27 comprises a crankshaft and is clamped by a plunger 28 of a first solenoid SOL1 (refer to FIGS. 1 and 2) fixed to the rear surface of the base 1. When the first solenoid SOL1 is energized by an output of first level from the coils 17 and 17' upon detection of the coin C1 or C2, the plunger 28 is moved downward in FIGS. 1 and 2. The plunger 28 pivots the shaft 27 so that the first selector 24 is pivoted toward the front in a direction perpendicular to the sheet of FIG. 1, e.g., clockwise seen from the plunger 28, and allows the coin path 12 to communicate with the authentic coin path 25. Note that when the first solenoid SOL1 is not operated, the coin path 12 and the return path 26 communicate with each other.

As shown in FIGS. 1 to 4, a projection 29 projecting into the path 25 is provided to the second plate 20 defining the authentic coin path 25 in order to guide a coin in the base 1. A second selector 30 is provided immediately downstream from the lower curved portion (indicated by arrow 25*a*) of the authentic coin path 25. A shaft 31 of the selector 30 is pivotally supported by the base 1. The shaft 31 comprises a crankshaft and is clamped by a plunger 32 of a second solenoid SOL2. When the second solenoid SOL2 is operated by an output of second level from the coils 17 and 17' upon detection of a ¥100 coin C1, the second selector 30 is pivoted from a position indicated by a solid line to a position indicated by a broken line in FIG. 4, closes a 500 coin path 33, and opens a ¥100 coin path 34. More particularly, as mentioned above, the third plate 21 is provided between the base 1 and the second plate 20. The ¥500 coin path 33 is defined between the base 1 and the third plate 21. The ¥100 coin path 34 is defined between the third plate 21 and the second plate 20. ¥100 and ¥500 coins are directed to the corresponding one of the ¥500 and ¥100 coin paths 33 and 34 by the second selector 30.

Figure 5:
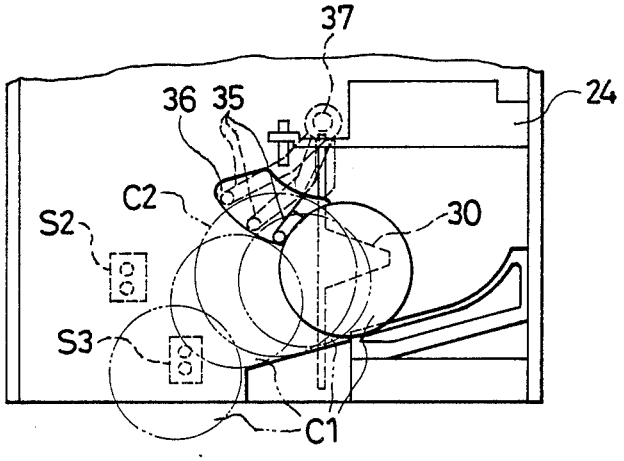
FIG. 5 is a partial sectional view taken along the line V—V of FIG. 1 for explaining operation of a string lever shown in FIGS. 1 and 2.

A string lever 35 is pivotally mounted on a shaft 37 (refer to FIG. 2) provided on the base 1. The distal end of the string lever 35 projects into the ¥500 and ¥100 coin paths 33 and 34 through a hole 36 formed in the base 1. As shown in FIG. 5, the distal end of the string lever 35 is located downstream in the paths 33 and 34 with respect to the shaft 37 of the lever 35. The ¥500 and ¥100 coins C2 and C1 pass downward along the paths 33 and 34 as they push up the string lever 35. Sensors S2 and S3 are provided further downstream in the paths 33 and 34 in order to detect the ¥500 and 100 coins, respectively. Detection outputs from the sensors S2 and S3 are used as a control input to an automatic vending machine incorporating the apparatus of the present invention.

Figure 6:
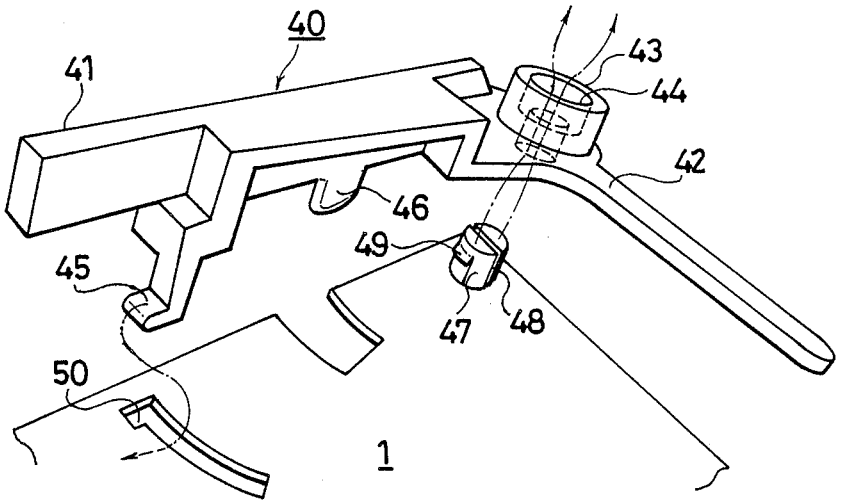
FIG. 6 is a partially exploded perspective view of a return lever shown in FIG. 1.

A return lever 40 is provided to the rear surface of the base 1 as shown in FIG. 2. As shown in FIG. 6, an urging member 46 is integrally formed by plastic molding with the return lever 40 in order to urge a handle 41, an elastic rod 42, a pivot portion 43, a lock member 45 and the first plate 3. A hole 44 formed in the pivot portion 43 has a large diameter portion at an upper end thereof and a small diameter portion at a lower end thereof. A projection 47 on the base 1 is engaged with the hole 44. The projection 47 is divided into halves by a slit 48. A distal end 49 of the projection 47 comprises a collar. When the hole 44 in the return lever 40 is engaged with the projection 47 while biasing the halves of the projection 47 inward by utilizing the slit 48, the collar-like distal end 49 of the projection 47 is engaged with the large diameter portion of the hole 44, and the return lever 40 is pivotally supported by the projection 47 so that it will not be disengaged from the projection 47. The lock member 45 of the return lever 40 is inserted in a hole 50 formed in the base 1 so that the lever 40 is engaged with the base 1 through the lock member 45 so as not to be movable along an extending direction thereof. Therefore, even when a force acts on the lever 40 to flex the slit 48 in the projection 47, the force does not act on the projection 47, thereby preventing the return lever 40 from being disengaged from the projection 47. The elastic rod 42 is engaged with a projection 51 formed in the base 1 in order to normally maintain the return lever 40 at a position shown in FIG. 2. Reference numeral 52 denotes a coin return member. A middle portion of the coin return member 52 is pivotally supported by a pivot portion 53 on the base 1. A spring 54 is mounted on one end of the coin return member 52 in order to bias the base 1. Therefore, the other end 55 of the return member 52 is inserted into the authentic coin path 25 through a hole 56 formed in the base 1, thereby closing the base of the path 25. A cam follower 57 is provided on a half portion of the return member 52 on the side of the other end 55 in order to engage with a cam surface 61 on a slidable member 60. The slidable member 60 is biased upward in FIG. 2 by a spring 62 provided between the slidable member 60 and the base 1. When the coin return lever 40 is pushed, its distal end urges and moves the slidable member 60 downward so that the cam follower 57 is moved by the cam surface 61 toward the front along a direction perpendicular to the sheet of FIG. 2, thereby removing the end 55 of the return member 52 from the authentic coin path 25. Note that reference numeral 63 denotes a cable; and 64, a mounting member of the second solenoid SOL2.

The operation of the coin discriminating apparatus according to the embodiment of the present invention will now be described.

When a coin is inserted in the coin insertion port 13, it passes downward along the coin path 12 while being urged against the base 1 by the first coin regulating member 14. The coin is detected by the sensor S1 and the coils 17 and 17'. When a counterfeit coin or a coin other than a ¥500 coin C2 or a ¥100 coin C1 is inserted, a change the same as that when an authentic coin is inserted does not occur in the magnetic flux of the coils 17 and 17' even if the coin is detected by the sensor S1. Therefore, the solenoids SOL1 and SOL2 are not operated. In this case, the coin passes downward along the coin path 12 while being urged against the base 1 by the second coin regulating member 18, and then collides with the absorber lever 19. The impact is absorbed by the absorber lever 19 and the passing direction of the coin is changed to downward so that the coin drops. The solenoid SOL1 is not operated and the first selector 24 closes the authentic coin path 25. Therefore, the coin passes on the upper surface of the first selector 24 in FIG. 1 and is returned through the coin return path 26 between the second front cover 23 and the second plate 20.

On the other hand, when either a ¥500 coin C1 or a 100 coin C2 is inserted, the coin is detected by the coils 17 and 17' to operate the solenoid SOL1. The crankshaft 27 is pivoted to pivot the first selector 24, close the coin return path 26, and then open the authentic coin path 25. As a result, the coin C2 or C1 drops into the authentic coin path 25, is urged against the base 1 by the projection 29, and guided in another direction at the closed bottom of the authentic coin path 25 constituted by the end 55 of the coin return member 52. At this point, the coin is discriminated as a ¥500 coin C2 or a ¥100 coin C1 by the second selector 30. More particularly, when a ¥500 coin C2 is detected by the coils 17 and 17', the solenoid SOL1 is operated but the solenoid SOL2 is not operated. The coin C2 is guided to the ¥500 coin path 33 and passed downward therealong while pushing up the string lever 25. The coin C2 is then detected by the sensor S2 to generate a ¥500 reception signal. When a ¥100 coin C1 is detected, the solenoid SOL2 as well as the solenoid SOL1 is operated to pivot the second selector 30 as shown by a broken line in FIG. 4, thereby closing the ¥500 coin path 33 and opening the ¥100 coin path 34. The ¥100 coin C1 passes downward along the ¥100 coin path 34 while pushing up the string lever 35, and is detected by the sensor S3.

When the coin path 12 is jammed by an inserted coin, the handle 41 of the coin return lever 40 may be pushed to bend the elastic rod 42, so that the return lever 40 is pivoted about the pivot portion 43, and the distal end of the handle 41 pushes the slidable member 60 against the spring 62 downward in FIG. 2. At the same time, the urging member 46 urges an inclined surface 65 formed on the first plate 3 (refer to FIG. 3), and pivots the first plate 3 about the shaft 5 against the biasing force of the spring 11, thereby allowing the coin jammed in the coin path 12 between the first plate 3 and the base 1 to drop and be returned. When the slidable member 60 is moved downward, the cam surface 61 pushes up the cam follower 57 to pivot the coin return member 52 about the pivot portion 53 against the biasing force of the spring 54. The base of the authentic coin path 25 defined by the end 55 of the return member 52 is opened through the hole 56, and the coin jammed in the authentic path 25 is returned. When the force applied to the return lever 40 is removed, the lever 40 is returned to a position shown in FIG. 2 by a force of the elastic rod 42, and the slidable member 60 and the coin return member 52 are returned to positions shown in FIG. 2 by biasing forces of the springs 62 and 54, respectively.

A method to prevent cheating by using a coin suspended with a string will be described. As shown in FIG. 5, a discriminated ¥500 coin C1 or ¥100 coin C2 passes downward along the corresponding path 34 or 33 while pushing up the string lever 35 projecting into the path 34 or 33 in the manner described above. If a string is attached to the coin and pulled up to move the coin upward in the reverse direction, the coin attempts to pivot the string lever 35 counterclockwise as shown in FIG. 5. However, the string lever 35 cannot be pivoted since it is locked by an edge of the hole 36 formed in the base 1. Therefore, the coin cannot be moved upward in the reverse direction. If the string is pulled strongly, it will snap and the coin will drop to be stored.

In the embodiment described above, a ¥500 coin and a ¥100 coin are discriminated. However, coins of other two denominations can be discriminated. If more coin paths, solenoids and selectors for guiding coins to the respective coin paths are provided, coins of three or more denominations can be discriminated.

According to the present invention, various advantages as follows can be obtained:

(i) Coin paths are vertically provided to be aligned with each other so that a coin can be directed to any of the coin paths by a selector. In addition, the selector is driven by a solenoid operative in response to a coil for discriminating the coin, so that the coin can be discriminated by only the selector, thereby decreasing the size of the coin discriminating apparatus and the number of components thereof.

(ii) A selector is provided immediately downstream from a lower curved portion of the coin path so that the coin passing downward at an increased speed does not collide with the selector, thereby preventing the selector from being damaged by the impact.

(iii) A regulating means to regulate movement of the coin toward either of the plates defining the coin path is provided at a position slightly upstream from the position at which the selector is provided. Therefore, the coin cannot undesirably move within the coin path to abut against the selector, thereby preventing damage to the selector and adverse influence on discrimination.

What is claimed is:

1. A coin discriminating apparatus comprising:

a common coin path through which all inserted coins to be discriminated pass downward, said common coin path having a curved portion and extending obliquely of said apparatus to said curved portion at which the downward movement direction of a coin is changed, and then extending vertically of the apparatus;

a detection coil means arranged to oppose said common coin path for detecting the denomination of the coin and discriminating a counterfeit coin from an authentic coin;

a return coin path and a first authentic coin path each disposed at a location downstream of said common coin path, said return coin path and said first authentic coin path each extending vertically of said apparatus and defined between a plurality of plate members;

a plurality of second authentic coin paths each corresponding to an associated one denomination of coin, said second authentic coin paths being stacked with each other and with said return coin path and said first authentic coin path and defined between said plurality of plate members, said second authentic coin paths having an upper section which extends from said first authentic coin path and then extends obliquely and in a direction opposite to that of said common coin path;

a first solenoid operative in response to the discrimination of a counterfeit coin from an authentic coin by said detection coil means and a second solenoid operative in response to a detection of a denomination of a coin by said detection coil means;

a first selector means disposed at a location downstream of said curved portion of said common coin path for passing all of said inserted coins therethrough and for diverting counterfeit coins to said return path and authentic coins to said first authentic coin path, said first selector means being arranged for pivotal movement around a shaft extending horizontally of said apparatus and in a direction along which said second authentic coin paths, said return coin path and said first authentic coin path are stacked, so as to communicate said common coin path with said first authentic coin path and said return coin path when said first selector means is selectively operated by said first solenoid; and a second selector means disposed at a location downstream of a lower curved portion of said first authentic coin path and downstream of said first selector means for passing only authentic coins therethrough and for sorting authentic coins by denomination into said second authentic coin paths, said second selector means being arranged for pivotal movement around a shaft extending vertically of said apparatus and in the direction along which said second authentic coin paths, said return coin path and said first authentic coin path are stacked, so as to direct the authentic coin to a corresponding one of said second authentic coin paths when said second selector means is operated by said second solenoid.

2. An apparatus according to claim 1, wherein a hole is formed in said plate members aligned with each other for forming said coin paths therebetween in units of denominations, and a string lever which crosses each of said coin paths in units of denominations through said hole and which is oscillated by a coin passing downward is provided, so that said string lever is engaged with an edge of said hole when a string is attached to an inserted coin to move the coin in the reverse direction, thereby preventing reverse passage of the coin suspended with the string.

* * * * *